US009868604B2

(12) United States Patent
Repetyuk et al.

(10) Patent No.: US 9,868,604 B2
(45) Date of Patent: Jan. 16, 2018

(54) BANKNOTE ALIGNMENT SYSTEM FOR BANKNOTE VALIDATOR

(71) Applicant: CRANE CANADA CO., Concord (CA)

(72) Inventors: Dmytro Repetyuk, Thornhill (CA); Sergiy Androsyuk, Etobicoke (CA); Vitold Khvostov, Kiev (UA); Roman Davydovskiy, Kiev (UA)

(73) Assignee: Crane Canada Co., Concord, Ontario (CA)

( * ) Notice: Subject to any disclaimer, the term of this patent is extended or adjusted under 35 U.S.C. 154(b) by 0 days.

(21) Appl. No.: 14/776,690

(22) PCT Filed: Mar. 14, 2014

(86) PCT No.: PCT/CA2014/000260
§ 371 (c)(1),
(2) Date: Sep. 14, 2015

(87) PCT Pub. No.: WO2014/138929
PCT Pub. Date: Sep. 18, 2014

(65) Prior Publication Data

US 2016/0031664 A1 Feb. 4, 2016

Related U.S. Application Data

(60) Provisional application No. 61/791,155, filed on Mar. 15, 2013.

(51) Int. Cl.
*B65H 7/08* (2006.01)
*B65H 9/00* (2006.01)
(Continued)

(52) U.S. Cl.
CPC ..... *B65H 9/002* (2013.01); *B65H 5/062* (2013.01); *B65H 7/08* (2013.01); *B65H 7/14* (2013.01);
(Continued)

(58) Field of Classification Search
CPC . B65H 9/002; B65H 7/14; B65H 9/20; B65H 7/08; B65H 2553/822; G07D 7/168
See application file for complete search history.

(56) References Cited

U.S. PATENT DOCUMENTS 5,078,384 A 1/1992 Moore
5,169,140 A 12/1992 Wenthe, Jr.
(Continued)

FOREIGN PATENT DOCUMENTS

DE 102008038771 A1 2/2010
EP 1321403 A1 6/2003
EP 2261150 A2 12/2010

OTHER PUBLICATIONS

International Search Report dated Jul. 2, 2014 in connection with International Patent Application No. PCT/CA2014/000260; 3 pages.
(Continued)

*Primary Examiner* — Jeremy R Severson

(57) ABSTRACT

A banknote drive arrangement adjacent a banknote inlet repositions and drives a banknote into a banknote processing pathway for validation. The drive arrangement includes two drive rollers preferably spaced either side of a longitudinal axis of the pathway and adjacent to the banknote inlet. Each drive roller is separately controlled to allow different rotational speeds thereof (and forward and rearward movement Of a banknote) to allow shifting of a received end portion of a banknote before receiving the entire length of the banknote. This arrangement is preferably used with a sensing arrangement for sensing misalignment of an inserted banknote and if sensed, using the different rotational speeds to correct misalignment and preferably center a banknote in the processing pathway.

26 Claims, 10 Drawing Sheets

(51) Int. Cl.

| | |
|---|---|
| ***G07D 7/16*** | (2016.01) |
| ***B65H 5/06*** | (2006.01) |
| ***B65H 7/14*** | (2006.01) |
| ***B65H 9/20*** | (2006.01) |

(52) U.S. Cl.

CPC ..... *B65H 9/20* (2013.01); *G07D 7/168* (2013.01); *B65H 2301/3611* (2013.01); *B65H 2403/944* (2013.01); *B65H 2404/10* (2013.01); *B65H 2404/611* (2013.01); *B65H 2511/20* (2013.01); *B65H 2513/104* (2013.01); *B65H 2513/53* (2013.01); *B65H 2553/412* (2013.01); *B65H 2553/416* (2013.01); *B65H 2553/822* (2013.01); *B65H 2701/1311* (2013.01); *B65H 2701/1912* (2013.01)

(56) References Cited

U.S. PATENT DOCUMENTS

| | | | | |
|---|---|---|---|---|
| 5,443,257 | A * | 8/1995 | Sakamori | G07D 7/16 271/228 |
| 5,755,437 | A | 5/1998 | Ek | |
| 6,149,150 | A * | 11/2000 | Onipchenko | G07F 7/04 271/227 |
| 6,164,642 | A * | 12/2000 | Onipchenko | B65H 9/101 271/171 |
| 6,578,844 | B2 | 6/2003 | Acquaviva et al. | |
| 6,634,521 | B1 | 10/2003 | Hwang | |
| 6,672,581 | B2 | 1/2004 | Lee et al. | |
| 6,860,480 | B2 | 3/2005 | Saltsov et al. | |
| 6,997,455 | B2 * | 2/2006 | Romine | B41J 11/0055 271/227 |
| 7,950,655 | B2 * | 5/2011 | Park | B07C 5/34 271/10.03 |
| 8,113,511 | B2 * | 2/2012 | Kallin | B65H 9/166 271/228 |
| 8,910,936 | B2 * | 12/2014 | Tsou | B65G 47/24 198/395 |
| 2004/0239027 | A1 * | 12/2004 | Trovinger | B65H 7/08 271/227 |
| 2010/0126827 | A1 * | 5/2010 | Fehrenbach | B65H 9/002 198/394 |
| 2010/0164164 | A1 * | 7/2010 | Kondo | B65H 9/002 271/3.24 |
| 2011/0011774 | A1 | 1/2011 | Yokota et al. | |
| 2012/0267847 | A1 * | 10/2012 | Ootsuka | B65H 7/08 271/234 |
| 2013/0334770 | A1 * | 12/2013 | Fehrenbach | B65H 5/062 271/228 |

OTHER PUBLICATIONS

Foreign Communication from Related Counterpart Application; European Patent Application No. 14763276.4; Supplementary European Search Report dated Oct. 5, 2017; 4 pages.

Foreign Communication from Related Counterpart Application; European Patent Application No. 14763276.4; Communication Pursuant to Article 94(3) EPC dated Oct. 20, 2017; 7 pages.

* cited by examiner

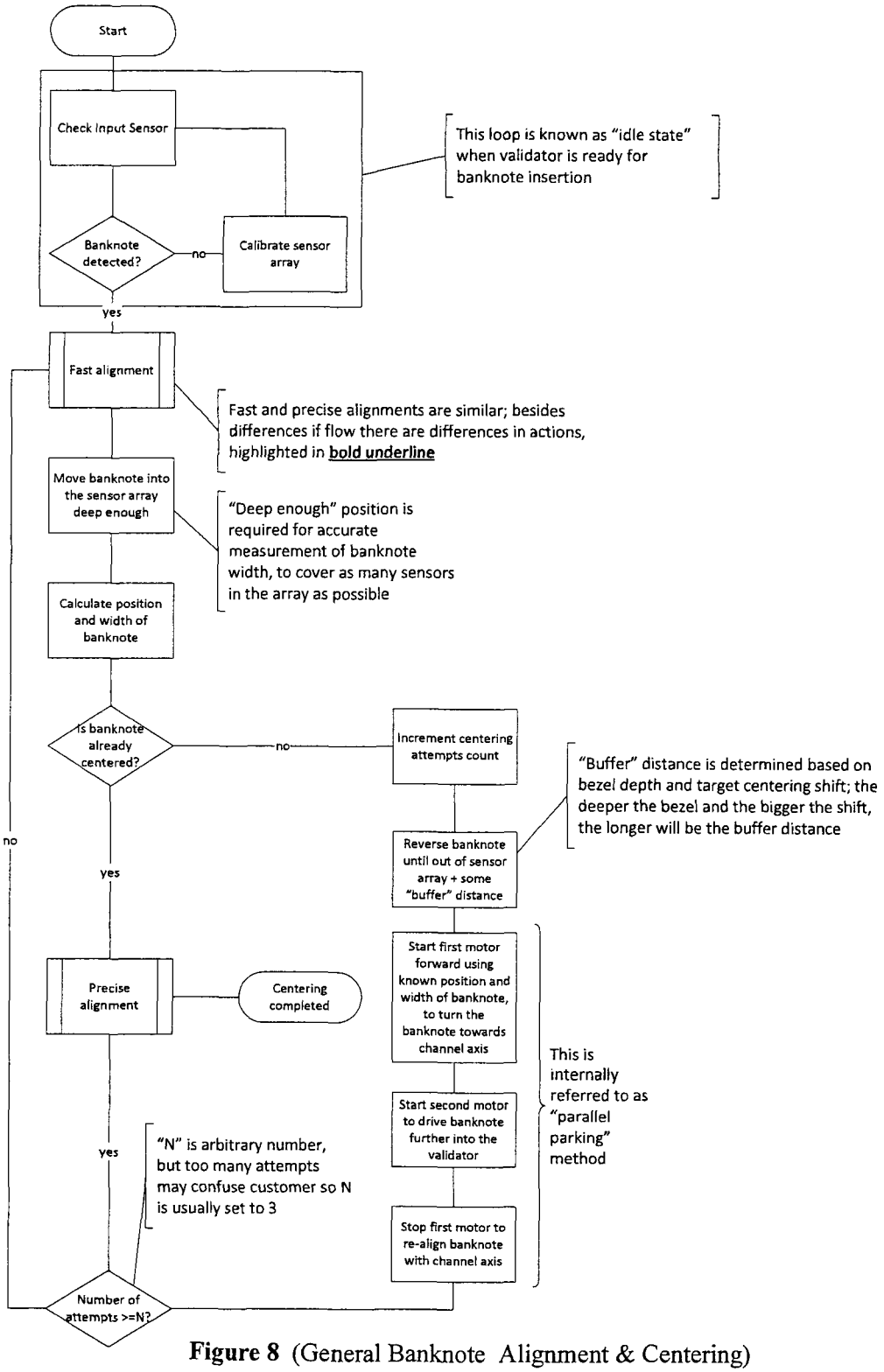
Figure 8 (General Banknote Alignment & Centering)

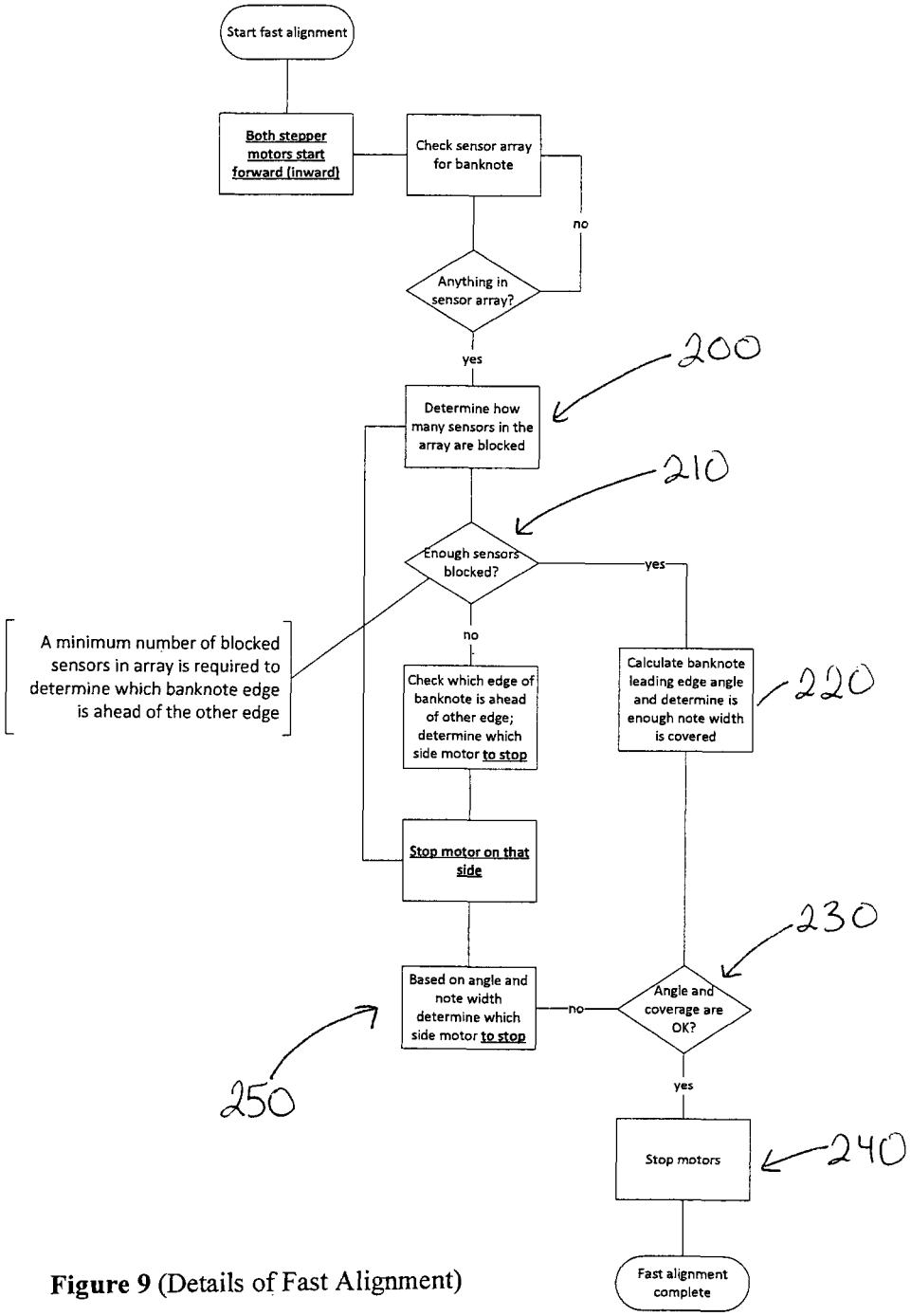
Figure 9 (Details of Fast Alignment)

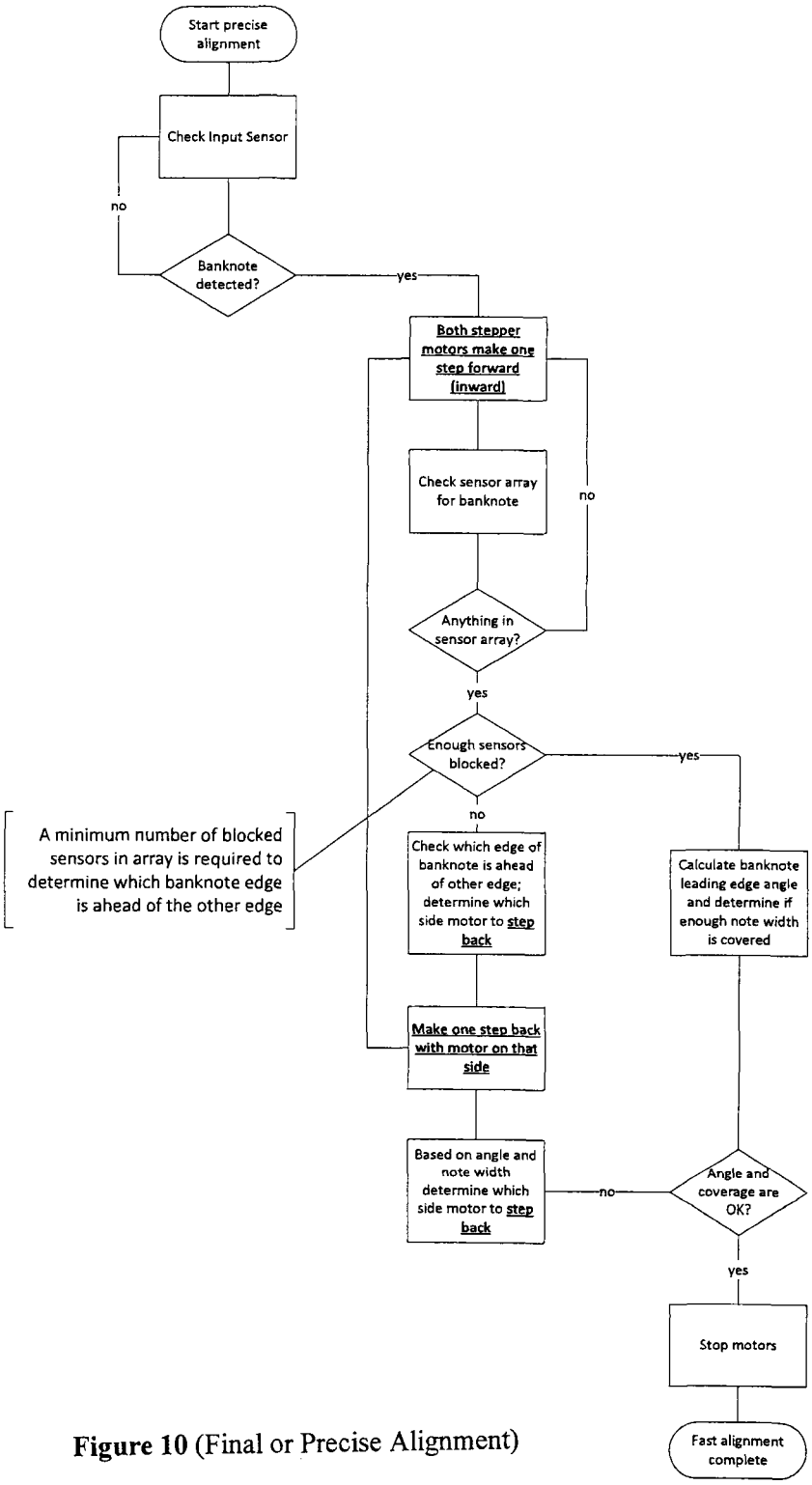
Figure 10 (Final or Precise Alignment)

BANKNOTE ALIGNMENT SYSTEM FOR BANKNOTE VALIDATOR

CROSS-REFERENCE TO RELATED APPLICATION(S)

The present application claims priority under 35 U.S.C. §365 to International Patent Application No. PCT/CA2014/000260 filed Mar. 14, 2014, entitled "BANKNOTE ALIGNMENT SYSTEM FOR BANKNOTE VALIDATOR" International Patent Application No. PCT/CA2014/000260 claims priority under 35 U.S.C. §365 and/or 35 U.S.C. §119(a) to U.S. Patent Application No. 61/791,155 filed Mar. 15, 2013, which is incorporated herein by reference into the present disclosure as if fully set forth herein.

FIELD OF THE INVENTION

The present invention relates to document centering mechanisms and in particular banknote centering and alignment mechanisms for banknote validation.

BACKGROUND OF THE INVENTION

Depending upon the particular currency, the width of a banknote may vary. For example, it is very common in European countries to have currencies of different widths associated with different denominations. Even in countries where the banknote width is the same for all denominations, for example Canada and the United States, banknote centering may be desired, particularly to simplify the validation process.

Alignment of a banknote with the axis of the banknote processing path, even if the banknote is not centered, simplifies the validation of the banknote as movement of the banknote past each sensor senses a strip portion of the banknote at a fixed position in the width of the banknote. Centering the axis of the banknote with the axis of the processing path further simplifies the validation as each banknote is then centered and sensing at predetermined positions in the width is completed.

Attempting to validate a banknote that is not at least aligned is difficult and there is a significant risk of banknote jamming.

Typically mechanical type arrangements have been used to center a banknote by engaging the sides thereof where the banknote has been released and floats freely within a banknote channel to allow centering of the banknote. U.S. Pat. Nos. 6,164,642 and 6,149,150 are examples of a mechanical type arrangement for centering of a banknote.

The present invention departs from the conventional release and mechanical centering of a banknote and utilizes a particular drive that repositions a leading edge of the banknote. Preferably only an end portion of the banknote is inserted in a processing channel of a banknote validator and shifted of centered prior to the banknote being fully received.

SUMMARY OF THE INVENTION

The present invention is directed to a centering arrangement and method used to reposition and center an end portion of a banknote.

A banknote validator according to the present invention includes a particular initial drive. The banknote validator includes a banknote processing pathway through which banknotes are moved for determining the validity thereof.

The banknote processing pathway includes at a downstream end thereof a banknote inlet through which banknotes are received. An initiation sensor is provided adjacent the banknote inlet and this sensor that is activated when a portion of a banknote is manually inserted through the banknote inlet. A pair of drive rollers spaced in the width of and partially projecting into the banknote processing pathway are provided at a position upstream of the initiation sensor. Each of the drive rollers includes an opposed passive roller located on an opposite side of and projecting into the banknote processing pathway to engage the respective drive roller when a banknote is not present and movable to accommodate the thickness of a banknote between the respective drive roller and passive roller. A power drive arrangement allows the same rotational speed or different rotational speeds of the drive rollers while the drive rollers maintain engagement with and drive a banknote into the banknote processing pathway. The drive arrangement is initiated by the activation of the initiation sensor and uses the different rotational speeds to correct misalignment of a received banknote. A series of evaluation sensors are located on a side of the banknote processing pathway to assess the validity of received banknotes as the received banknotes are driven through the banknote processing pathway.

In an aspect of the invention, the initiation sensor is adjacent to the drive rollers.

In a preferred aspect of the invention a sensing arrangement identifying misalignment of an inserted end of a banknote is positioned adjacent the drive rollers and produces a misalignment signal communicated to the power drive arrangement. The power drive arrangement based on the misalignment signal selectively drives the drive rollers at differential speeds to provide correction of the identified misalignment. Preferably the sensing arrangement is a sensing array extending across the banknote processing pathway adjacent to and upstream of the drive rollers.

In yet a further aspect of the invention, the initiation sensor is a sensor array that additionally detects misalignment of an inserted end of a banknote positioned adjacent the drive rollers and produces a misalignment signal communicated to the power drive arrangement. The power drive arrangement based on the misalignment signal selectively drives the drive rollers at differential speeds to provide correction of the identified misalignment. Preferably, the drive rollers are positioned on opposite sides of a centerline of the banknote processing pathway.

According to an aspect of the invention, the drive rollers have a fixed axis of rotation extending across the banknote processing pathway.

In a further aspect of the invention, the drive rollers are spaced from the banknote inlet a distance less than 20% of the length of a banknote capable of being validated by the banknote validator.

Preferably according to an aspect of the invention, the drive arrangement includes a stepper motor for each drive roller, and the drive rollers can be driven in a forward and rearward direction at equal or differential speeds.

In a preferred aspect of the invention, the drive arrangement includes a sequence of incremental forward and rearward drive steps to align a received banknote with at least 60% of the length of the banknote extending outwardly beyond the banknote inlet. Preferably, the drive arrangement includes a forward aligned drive mode wherein each drive roller is driven at the same rotational speed to move a banknote into said banknote processing pathway for validation by said series of evaluation sensors.

In yet a further aspect of the invention, the drive arrangement includes a banknote alignment mode comprising a series of incremental forward and rearward movement of a received end portion of a banknote used involving different rotational speeds of the drive rollers to align the banknote with the banknote processing pathway followed by a forward drive of said drive rollers at equal speed to move the banknote along the banknote processing pathway assessing the validity thereof.

Preferably the power drive arrangement comprises a separately controlled stepper motor associated with each of said drive rollers.

A banknote centering arrangement according to an aspect of the invention comprises a pair of stepper motors located to opposite sides of a longitudinal axis of the banknote processing pathway, and a sensor array extends across the banknote processing pathway capable of sensing the leading edge and side edges of a banknote as it is moved over the sensor array. The stepper motors are located between the banknote inlet and the sensor array. A control arrangement is provided that receives sensor information from the sensor array and based thereon determines drive of the stepper motors including a differential drive of the stepper motors to cause displacement and angular movement of the banknote necessary to align and center the banknote with respect to the longitudinal axis of the banknote processing pathway.

In an aspect of the invention an inlet sensor is provided that detects insertion of a banknote into the processing pathway and produces an initiation signal provided to the control arrangement. The control arrangement upon receipt of the initiation signal initiates drive of the stepper motors to advance the banknote towards the sensor array for angular evaluation.

In an aspect of the invention, the control arrangement selectively drives the stepper motors to move a received end of a banknote over the sensor array sufficiently to identify an angular orientation of the banknote relative to the banknote processing pathway and thereafter selectively drives the stepper motors in a series of forward and reverse movements across the sensor array involving differential actuation of the stepper motors to align the end of the banknote such that a longitudinal axis of the banknote is aligned with a longitudinal axis of the banknote processing pathway.

In a preferred aspect of the invention, the control arrangement selectively drives the stepper motors to move a received end of a banknote over the sensor array sufficiently to identify an angular orientation of the banknote relative to the banknote processing pathway and thereafter selectively drives the stepper motors in a series of forward and reverse movements across the sensor array involving differential actuation of the stepper motors to align the end of the banknote such that a longitudinal axis of the banknote is aligned with a longitudinal axis of the banknote processing pathway and the banknote is centered in the processing pathway.

In a further aspect of the invention, the controller causes the stepper motors to be driven synchronously in advancing the end of the banknote and differentially in reverse movement of the banknote.

In an aspect of the invention, the sensor array is spaced from the banknote inlet less than 40% of a length of a banknote to be aligned.

In a preferred aspect of the invention, the sensor array is positioned less than 5 centimeters from the banknote inlet.

In yet a further aspect of the invention the differential drive of the drive rollers in a forward direction is selectively used as part of alignment of the banknote end.

A method of banknote alignment according to the invention comprises a) sensing insertion of an end of a banknote into the banknote processing pathway;

b) activating a pair of stepper motors such that each stepper motor via a drive roller drives the end of the banknote at least partially over a sensor array extending across the processing pathway and stopping the stepper motors;

c) based on a collective response of sensors of the sensor array determining an approximate angle if the longitudinal axis of the received banknote is at an angle relative to the longitudinal axis of the banknote processing pathway, and reversing the stepper motors using a differential drive therebetween to provide at least a partial corrective movement of the banknote end;

d) repeating steps b) and c) until a satisfactory alignment is determined by the sensor array and thereafter driving each of the stepper motors equally to move the aligned banknote along the banknote processing pathway for evaluation.

BRIEF DESCRIPTION OF THE DRAWINGS

Preferred embodiments of the invention are shown in the drawings, wherein:

FIG. 8 is a flow chart of preferred logic used in association with controlling the drive rollers to provide alignment of a banknote;

FIG. 9 is a schematic showing additional processing logic used in alignment of a banknote; and FIG. 10 illustrates further processing logic used to provide alignment of a banknote with the center line of the banknote validator processing path.

DETAILED DESCRIPTION OF THE PREFERRED EMBODIMENTS

Figure 1:
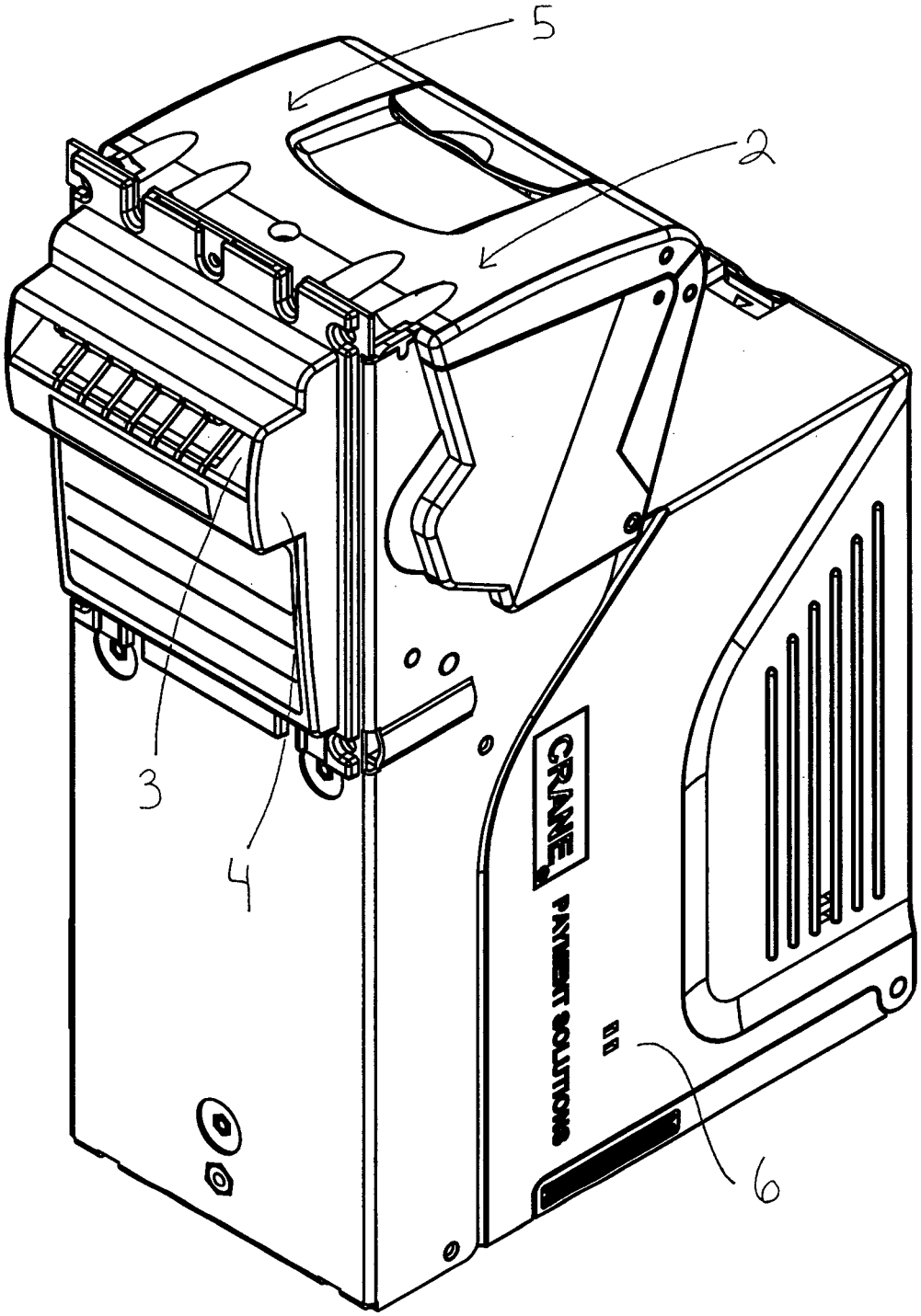
FIG. 1 illustrates a back load validator with associated cash box that includes the banknote centering arrangement.

The banknote validator 2 includes an associated cash box 4 for storing banknotes that have been appropriately validated. The validator 2 includes a banknote processing slot 6 for inputting of banknotes to the validator.

The banknote alignment system can be appreciated from a review of FIGS. 1 through 4. The inlet 8 of the banknote processing slot 6 is oversized relative to the width of the banknotes to be processed. The banknote is passed through the banknote slot and is engaged by the drive rollers 10 and 12 positioned adjacent the slot. Each of these drive rollers 10 and 12 preferably include a separately driven stepper motor shown as 14 and 16 respectively (see FIG. 2 and FIG. 3). A leading edge sensor 18 senses the front edge of a banknote as a user inserts the banknote into the slot. The stepper motors 14 and 16 are activated and rotate drive rollers 10 and 12. The important aspect is the driver rollers 10 and 12 can be driven at different rotational speeds used to align or center a banknote.

Figure 2:
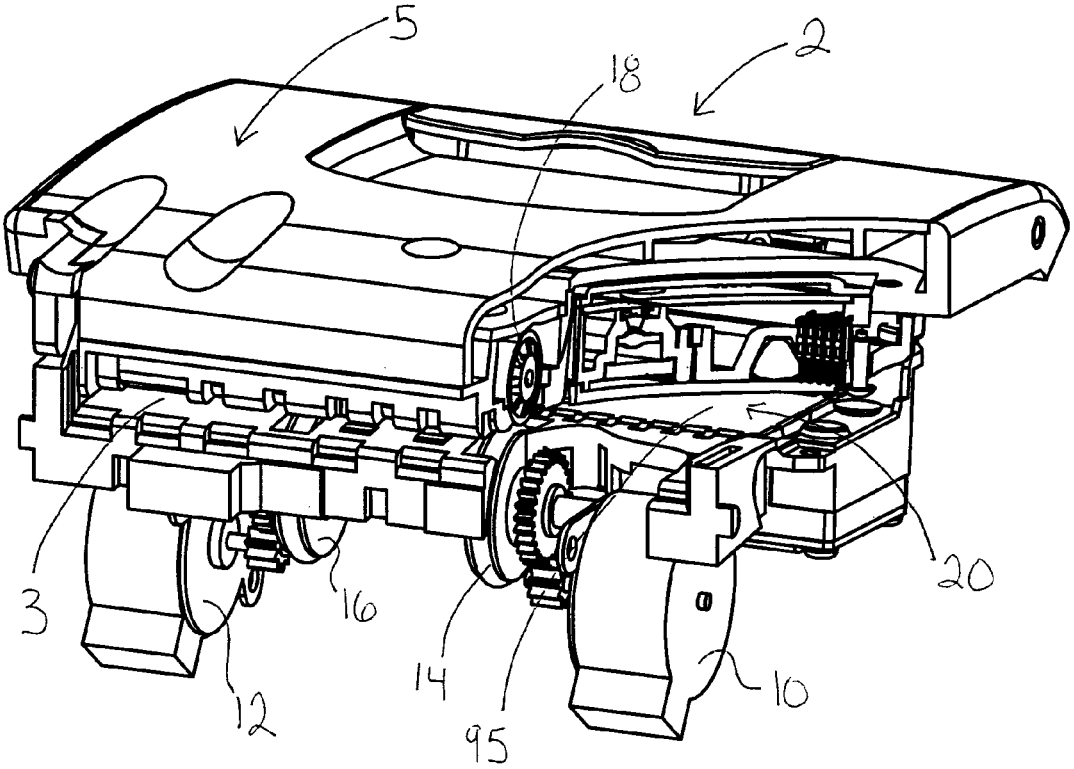
FIG. 2 is a perspective view of the banknote validator of FIG. 1 illustrating details of the drive and a sensor array used therein.
Figure 3:
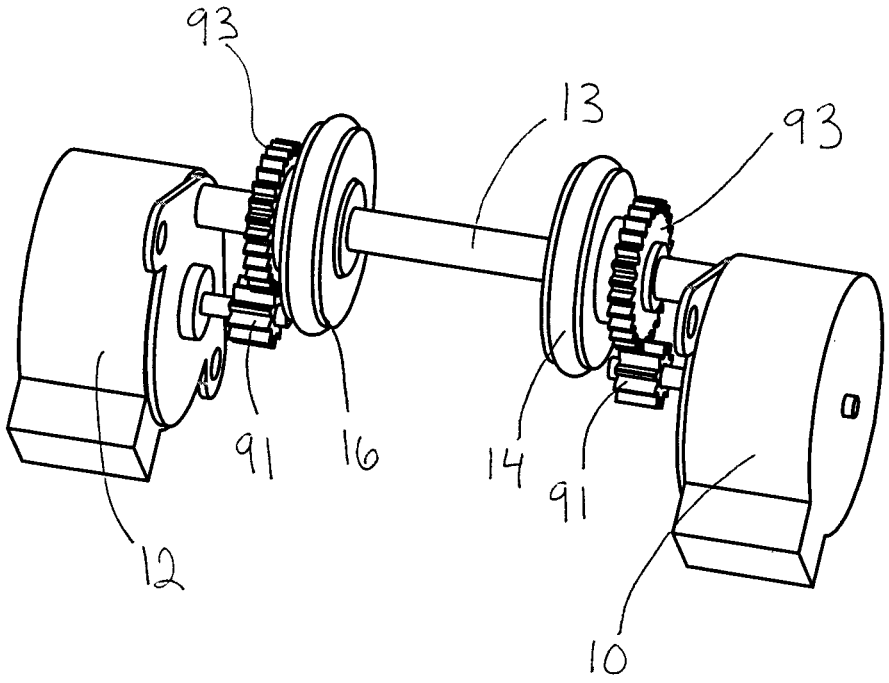
FIG. 3 is a perspective view of the two servo motors separately driving drive rollers bearingly mounted on a common shaft.

FIG. 2 and FIG. 3 show the preferred two servo motors 10 and 12 located to the outside of driver rollers 14 and 16 bearingly mounted on the common shaft 13. Each servo motor has a pinion gear 91 and a spur gear 93. Positioning the servo motors to the outside of the driver rollers 14 and 16 allows sufficient spacing of the rollers either side of a center line of the banknote processing pathway. Other arrangements are also possible. FIG. 3 also shows the pivoting top cover 5 of the validator that has been removed in the cut-away of FIG. 4. The top cover 5 includes sensors and also provides access to the banknote processing pathway 20.

Figure 4:
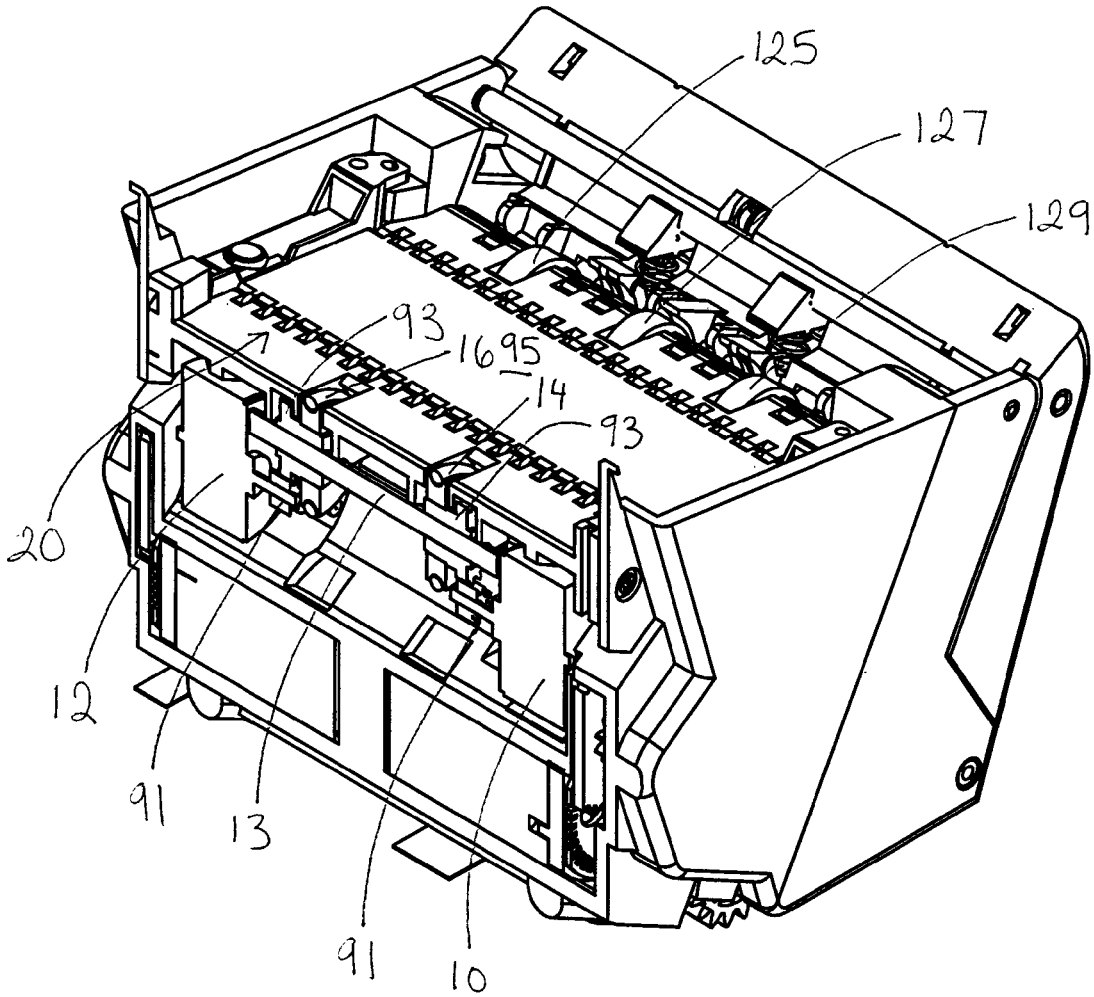
FIG. 4 is a cut-away perspective view through the stepper motors showing a preferred positioning of a pair of stepper motor drives and an associated sensor array.

The cutaway perspective view of FIG. 4 has a top portion of the validator removed to expose a portion of the banknote processing channel. The vertical section is through the servo motors 10 and 12 and it offset relative to the common shaft 13 that bearingly supports the rotatable drive rollers 14 and 16. With this arrangement each drive roller 14 and 16 is independently drivable with respect to both the rotation speed thereof and the direction of rotation.

FIG. 4 also shows the sensor module 95 that is inserted into a recess and forms part of the banknote processing pathway 20. The sensor module 95 is preferably one part of a two part sensor with a corresponding part on the opposite side of the pathway in the part presented removed. For example, the module 95 can include the desired number of photodio transmitters and the opposite component would be photodio receivers for sensing the interruption in the transmitted light associated with a banknote edge or the banknote overlying a particular sensor.

FIG. 4 also show driver rollers 125, 127 and 129. These driver rollers are used to transport the banknote through the processing pathway 20 once the banknote has been aligned. The alignment of a banknote occurs before the leading edge of the banknote reaches these rollers. Once a banknote has been aligned, these rollers are driven by a, separate transport motor and the servo motors 10 and 12 are driven in a synchronized manner to also transport the banknote through the banknote processing pathway. In the present design it can be seen that the banknote will undergo a redirection associated with the rollers 125, 127 and 129.

Although the sensor module 95 has been described with respect to sensing the leading edge of the banknote, additional sensors can be provided for sensing the banknote and determining the properties thereof as the banknote is eventually transported through the validator.

Figure 5:
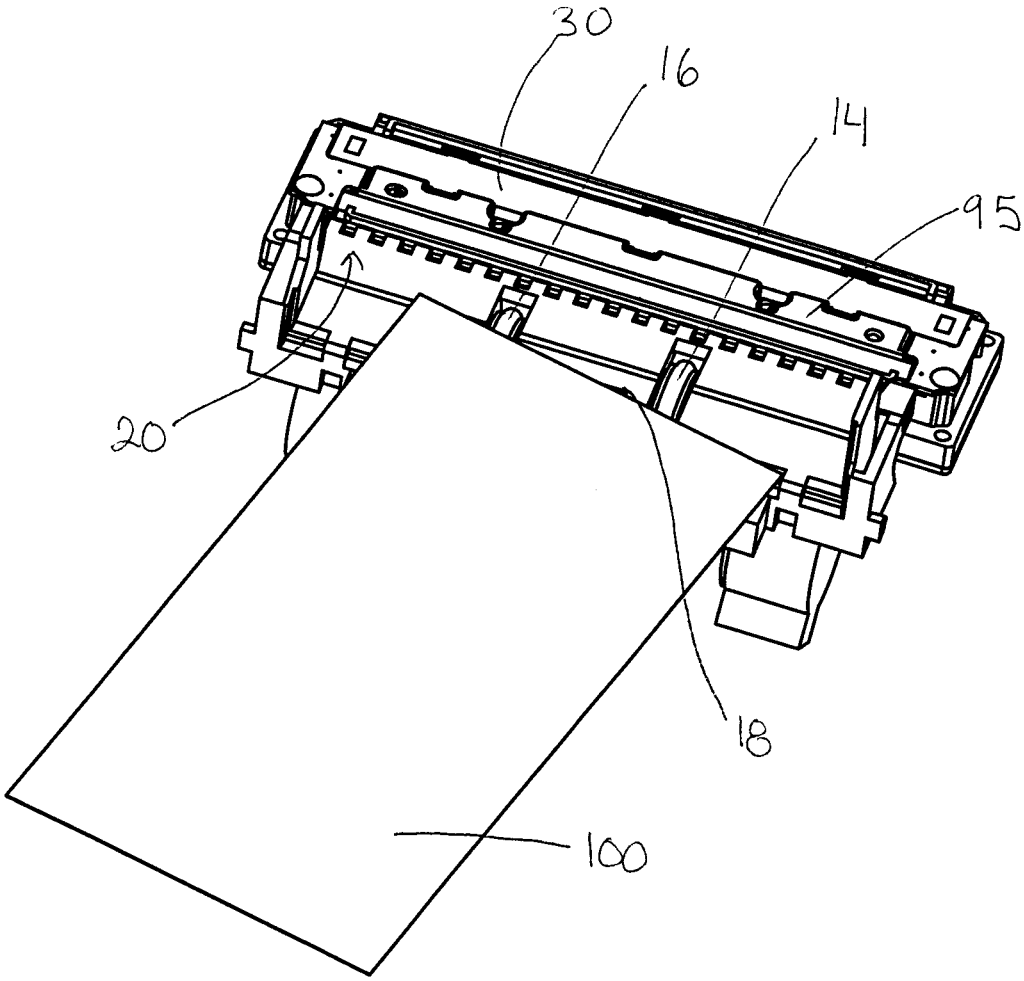
FIG. 5 is a schematic view of a banknote about to be engaged by the drive rollers for initial movement into the validator to be sensed by a sensor array.
Figure 6:
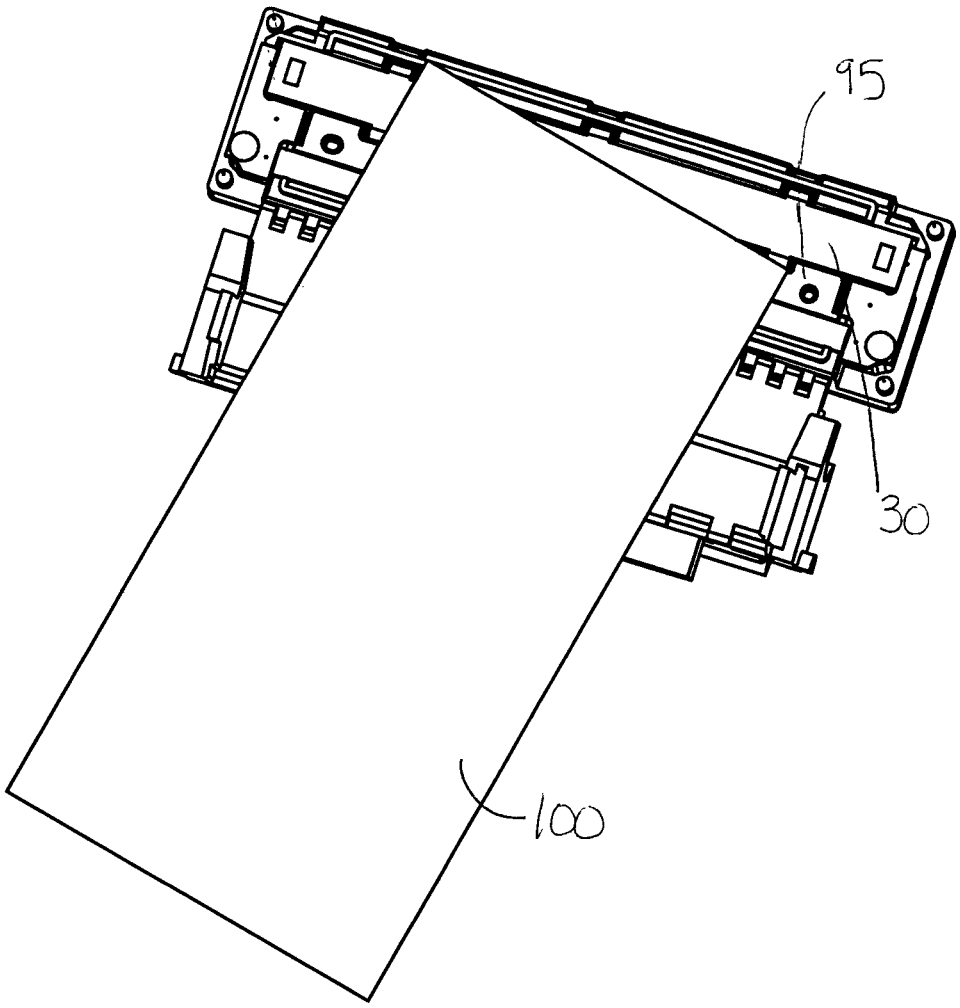
FIG. 6 is a view similar to FIG. 5 where the banknote has been driven into the validator and the sensor array has determined the banknote is at an angle or position requiring correction.
Figure 7:
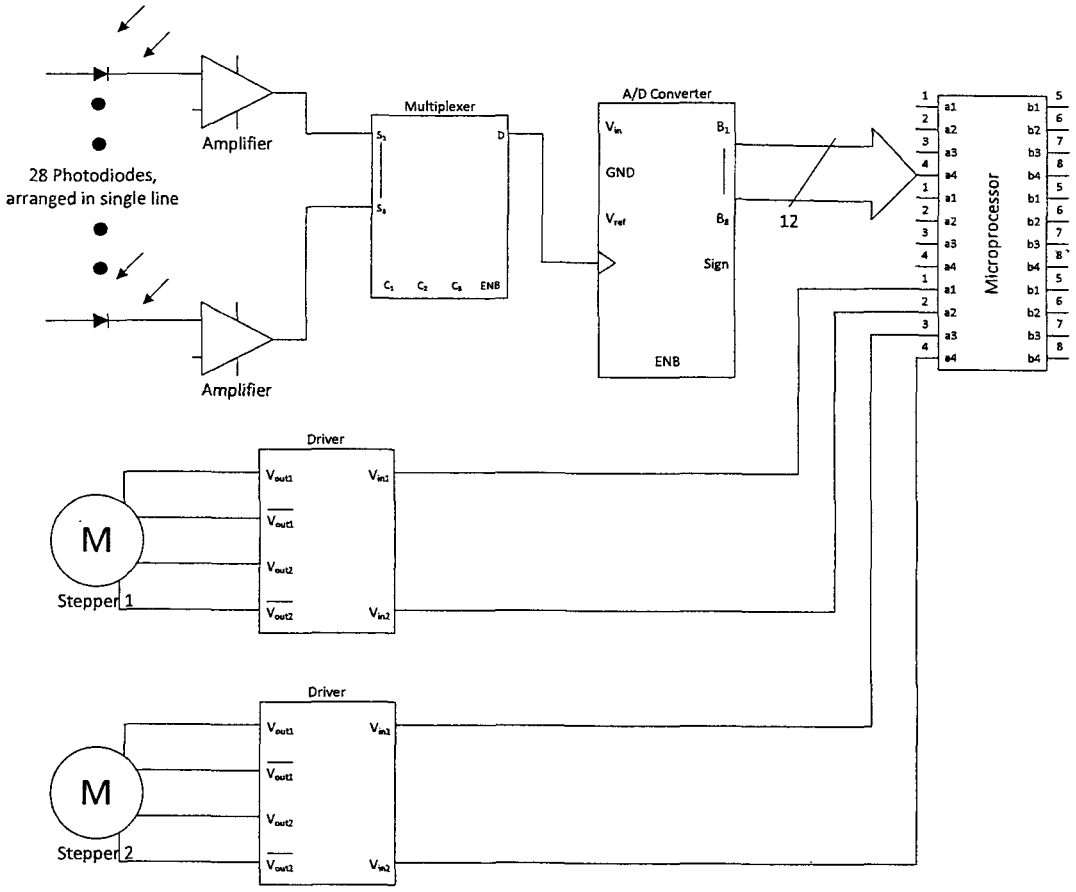
FIG. 7 is a simplified schematic diagram of the processing of the signals from the sensor array.

FIGS. 5 and 6 show a typical entry of a banknote 100 as it is entering and being processed by the validator. The banknote 100 has been presented at an angle to the banknote path and the insertion of the banknote has activated the input sensor 18 and caused the drive rollers 10 and 12 to be activated. At this point in time the validator does not know the particular angle of the banknote 100 and the drive rollers 10 and 12 start to advance the banknote assuming the drive rollers are in contact with the banknote. The banknote is advanced into the banknote processing path 20 and the leading edge and an approximate angle thereof will be detected by the sensor array 30 which has a series of individual sensors spaced in the length of the sensor array (width of the banknote processing path). Preferably the sensor array has as many as 28 individual sensors (typically photo diodes) which can accurately determine the angularity of the banknote leading edge as it moves across the sensor array. For example, perhaps 6 or 7 of the sensors have been interrupted by the leading edge of the banknote 100 with the banknote in the position of FIG. 6. The number of sensors interrupted and/or the timing of the interruptions can allow an appropriate angle determination. Also identification of the interrupted sensors provides information with respect to a non centered position of the banknote and a direction of correction.

The activation of the individual sensors of the sensor array 30 as the leading edge of the banknote passes thereover provides information with respect to both the position of the leading edge of the banknote and the angle of the banknote relative to the processing path 20. The logic associated with the banknote alignment procedure preferably requires a certain number of the individual sensors to be interrupted before any steps for correcting the alignment of the banknote are carried out. In a preferred embodiment the method causes each stepper motor to be driven forwardly until sufficient sensors are interrupted followed by determining which banknote side edge is more advanced, then reversing the stepper motor closest to the more advanced edge while the other stepper motor is not driven, then repeating the process until alignment is achieved. Alignment can be confirmed by the number and position of the interrupted sensors.

As can be appreciated from a review of FIG. 6 only a leading portion of the banknote has entered the banknote slot 6 and a large portion of the banknote extends outwardly of the banknote slot. This is advantageous as full or substantial support of the banknote is not required. This allows the validator to be smaller. The space allocated for the validator in a host device is limited.

To align and center the banknote in the banknote slot, the servo motors 14 and 60 are selectively driven. Each of the rollers 10 and 12 are preferably in contact with the banknote 100. In the position of FIG. 6 it can be appreciated that if the drive roller 10 is driven and the drive roller 12 is held stationary, the banknote will rotate or pivot about the engagement point (contact point) of drive roller 12 with the banknote as there is gripping engagement of the banknote. This will allow the longitudinal edges of the banknote to undergo rotation to align with the longitudinal axis of the banknote processing path and/or assume a correcting angular position to provide a shift of the banknote in the width of the processing pathway. Several corrective steps are typically required. Information from the sensor'arrays can determine when the banknote is aligned. Also given that only a certain number of sensors are initially activated indicating an overlapped condition with the leading edge of the banknote, the corrective rotation of roller 10 can be initially estimated and subsequently aligned during the procedure based on the response from the remaining sensors. A series of steps is often required. For example, forward movement at equal speed with the banknote at an angle allows a corrective shift.

With the differential drive of the rollers it is possible to provide an initial alignment of the banknote in the banknote processing path although the banknote is probably not yet centered. The number of activated sensors allows assessment of the amount of offset from a center aligned position. If the banknote is then selectively driven to shift the banknote in the banknote slot, the sensor array can confirm when the banknote has been centered (based on the selective drive of the drive rollers). By selective movement of the drive rollers 10 and 12 it is possible to shift the center of the banknote to align with the centerline of the banknote path. This is accomplished in a series of steps and angling and movement of the banknote. It can also be appreciated, once a shift has occurred, that further movement of the banknote can confirm the centered alignment based on the sensor array response. The stepper motors provide accurate rotation of the rollers and it can be appreciated that the driving of only one of the rollers effectively causes a rotation of the banknote about the point of contact of the other roller with the banknote. Typically both forward and rearward movement is used.

With the arrangement as shown in FIGS. 1 through 6, it can be appreciated that the full sensor array in combination with the two drive rollers can be used to selectively shift (wiggle) the leading edge of the banknote in the banknote processing path and then subsequently drive the banknote along the banknote processing path once it has been aligned and preferably centered.

The design is compact (space efficient) and this is desirable as the size of the validator and the amount of space allocated for the payment system in an associated host machine is often limited. With this design there is no requirement for an extended bezel portion of the validator to support a substantial portion of the banknote that is extending out of the validator. For example, if the centering mechanism requires the banknote to float (as would be the case in the prior art arrangements) a longer support arrangement is required to avoid the possibility of the banknote falling out of the banknote slot. Also, even if the banknote is centered, if it is not properly supported it could partially fall out or the alignment and centering could be lost due to movement. In the present system engagement of the banknote can be maintained throughout the procedure.

The present design is not only space efficient; it is also cost effective in that the drive rollers 10 and 12 also drive the banknote along the banknote path once it has been aligned and centered. There is no drive motor only associated with a centering mechanism as found in the prior art. This design allows centering without substantial additional cost.

With the operation of the alignment system it can be appreciated that two independently controlled stepper motors with drive rollers (preferably connected thereto by the simple dedicated gear train) form part of the initial engagement and centering of the banknote. The selective activation of the stepper motors allows the banknote position to be precisely controlled and adjusted as each motor can be rotated a certain amount (number of steps) that translates into an angle of rotation and correspondingly into a known banknote movement. When one of the motors is stopped and the other motor is rotated, the banknote turns or pivots around the stopped roller. The roller engages the banknote in that a spring loaded passive roller is provided above the driven roller and the driven roller preferably has an O-ring or drive surface with a round cross section to allow the banknote rotation as opposed to a flat and larger engagement surface that would provide more resistance. Driving both motors equally when the banknote is at an angle causes a shift of the centerline of a banknote. Differential drive of the banknote causes a change in the angle of the banknote. Back and forth movement including repeated testing for alignment allows a fast efficient centering of the banknote.

The operation has been described with respect to one stepper motor being stopped while the other stepper motor is reversely rotated however other differential speed combinations can be used. The stepper motors are able to start, accelerate and stop quickly and accurately and allow multiple steps in a short period of time.

The sensor array is used in conjunction with the stepper motors and rollers to provide feedback. It is desirable that the sensor array spans the channel as this provides good information to assess the banknote angle in the banknote slot and any offset of the banknote in the banknote processing channel.

The design shown in the Figures uses a sensor array preferably having 28 sensors to span approximately 85 mm across the channel width. Although 28 sensors provide accurate assessment, as few as 10 sensors can provide sufficient information. The number of sensors affects the precision of the initial alignment assessment and more sensors may simplify the processing of the motor controls to effect alignment and subsequent centering. More sensors are particularly helpful for currency having different banknote widths and may reduce the number of corrective steps.

It is desirable that the light source and the sensor array is properly calibrated to provide consistency between the various elements including the same gain with respect to sensitivity. This simplifies the logic used to determine whether the sensor has been interrupted by the banknote.

With the present design, space efficiency is accomplished as the two stepper motors and rollers used to effect alignment combined are multipurpose and engage or hold the banknote during centering. The stepper motors are both used for the alignment function and with respect to the subsequent driving of the banknote along the path. The sensor array can also be used to sense certain characteristics of the banknote in addition to the position sensing if desired.

This design does not require the substantial space necessary of prior art centering structures having movable side members that move outwardly to a clear position. Furthermore it has been found that the present design has advantages regarding dust contamination and spill resistance. The drive rollers can be provided in molded cavities that cooperate to effectively isolate the cavities from the internal space of the validating head that includes the various sensors. These sensing components are vulnerable to dust and/or liquid contamination and are easily isolated. The sensor array and motors form a feedback system to provide fast alignment. The system is operated in the digital domain-output of each sensor in array is amplified and digitized using an Analog-to-Digital Converter (ADC), and stepper motors are digital by design and provide accurate movement and shifting of the banknote.

Operating the system in the digital domain provides important advantages reducing the cost and likelihood of oscillation and drift.

The analog to digital converter (ADC) provides twelve bits of resolution but this is a function of the scanning subsystem and not of the alignment subsystem. A much more modest resolution of seven and probably even six bits may be sufficient for many applications.

The entire system has single point of control—the Microprocessor. It is responsible for motor control, data collection from sensor and mathematical calculations. It is preferable to have at least the mathematical engine and motor control in one microprocessor because the inertial nature of stepper motors may introduce lag into the system if there is a considerable delay between data acquisition, calculations and motor control.

System operation is relatively simple and consists of three main phases:

Initial banknote alignment. This phase is fast and provides coarse alignment of the banknote in preparation for banknote centering;

Centering. It involves a reverse banknote movement and 2 turns—a turn toward channel center and an opposite turn to re-align the note. The entire phase visually resembles parallel parking of a car. The efficiency of this phase depends on the width of the banknote and the depth of attached validator bezel, because the wider the note and the deeper the bezel the less room there is to center the note. To overcome the inefficiency a validator uses a series of forward and reverse steps to center the banknote, gradually achieving better centering with each attempt;

Final banknote alignment. Final alignment is used to compensate for any mis-alignment introduced by centering phase, particularly if there was more than one attempt.

The logic used for controlling the stepper motors and the signals from the sensor array are shown in FIGS. 9 through 10. This particular design allows not only a compact arrangement for centering of a banknote and the cost effective sharing of components, it also allows for efficient time centering of a banknote and positive control of the banknote as it is being processed.

To provide some assistance in assessing the space efficiency of the design, the validating head is similar in size to a conventional validating head that does not include banknote centering. The actual space from the entry of the banknote slot to the sensor array is approximately 5 cm but can be greater depending upon the bezel. With respect to the processing speed of a banknote alignment, this is a function of the initial angle however banknotes are typically aligned and centered within approximately 0.5 seconds.

With respect to the portion of a banknote that extends beyond the banknote slot during the centering and alignment feature, with a United States banknote approximately 60% or more of the banknote extends outwardly of the banknote slot.

The initial alignment of a banknote is shown in FIG. 9. When the banknote is first inserted in the banknote slot the longitudinal axis of the banknote can be at an angle relative to the angle of the banknote passageway. The sensor array that extends across the banknote path provides information with respect to the leading edge of the banknote as well as the side edges of the banknote. The side edges of the banknote are confirmed by the position of the interrupted sensors, and thus one of the edges will be considered the leading side edge of the banknote and will be the side edge of the banknote that is initially detected. During the initial advance of a banknote into the banknote slot, each of the stepper motors is driven equally. Once a certain number of the sensors of the sensor array have been interrupted either by a leading edge or a side edge of the banknote, corrective action can be taken. At step 200 a determination is made with respect to how many of the sensors are blocked or interrupted. At step 210 two options are presented: if sufficient sensors are blocked, the answer is "YES" and a calculation is carried out at 220 to assess the angle of the leading edge and also determine whether sufficient width of the banknote has been moved over the sensors. At 230 if the angle and coverage are sufficient a decision is made to stop the motors as shown at 240. If the determination regarding the angle and coverage is not sufficient at step 230, then based on the angle and banknote width a decision is made at 250 which of the stepper motors should be stopped. The stepper motor associated with the leading side edge stops while the other motor is advanced. With this action a correction in the angle of the banknote will occur and additional sensors will be interrupted and sensed at step 200. The process is repeated until the banknote is aligned in the banknote processing path but the center line of the banknote may not be centered on the center line of the banknote processing path.

In FIG. 10 further alignment occurs to effectively shift the center line of the banknote to the center line of the banknote processing path. This occurs by selective reverse rotation of the stepper motors and advancement of the stepper motors. A series of forward/rearward steps can occur to effectively shift the centerline of the banknote in the desired direction.

The offset of the banknote relative to the center line of the banknote processing pathway can be determined by the interrupted sensors. If the interrupted sensors are not equally distributed either side of the center line of the banknote processing pathway corrective action is required. In the preferred embodiment the stepper motor associated with the edge of the banknote furthest away from the centerline is reversed a certain distance while the other stepper motor remains stationary. This step is followed by each of the stepper motors being driven forwardly and this effectively results in a shift of the centerline of the banknote relative to the centerline of the banknote processing pathway as the banknote is at a particular angle. This angle can be corrected by driving the other stepper motor in the reverse direction while the other motor remains stationary. The series of these repetitive steps can be taken to effectively shift the centerline of the banknote to the centerline of the banknote processing pathway. It can be appreciated that other particular arrangements for changing the relative speed and thus displacement of the banknote by the stepper motors can be used. It has been found that this particular arrangement is easy to operate, does not require a great deal of processing and can be carried out a number of times quite rapidly to effect the desired shift. Other arrangements for the separate control of the drive rollers can also be used.

One of the advantages of the present arrangement is with respect to the compact design and the ability to shift the banknote rapidly. By effectively aligning only an end portion of the banknote in the banknote processing path the width of the banknote processing path can be reduced. If more of the banknote is received in the banknote processing path, the additional length acts like a lever and therefore the banknote processing pathway width must accommodate the angle. There are space efficiencies by using a process that aligns the inserted end portion of the banknote as opposed to the centering length of a supported banknote. The much larger portion of the banknote that is hanging out of the banknote slot merely follows the controlled movement of the other end that is being centered.

With currencies of different widths, the smaller width banknotes can be inserted into the banknote slot at a greater angle and require greater correction. In addition, the amount of shifting required to effectively align the centerline of the banknote with the centerline of the banknote processing path can be greater. With currencies of a fixed width, the amount of shifting is less as the banknote opening can be relatively tight (i.e. close to the banknote width while still allowing the user to easily insert the banknote into the validator).

With the centering of a banknote there are a number of difficulties associated with the condition of the banknote, the changing width of the banknote, as well as the general condition of the banknote. Some banknotes, when initially placed in circulation, are quite stiff while banknotes that have been in extended circulation can be quite worn and flexible. Use of banknotes having a plastic type substrate generally reduces these variations. It has been found that the present banknote centering mechanism is quite tolerant with respect to the varying conditions of the banknote and thus the centering mechanism can center banknotes of varying conditions.

Although various preferred embodiments of the present invention have been described herein in detail, it will be appreciated by those skilled in the art, that variations may be made thereto without departing from the appended claims.

The embodiments of the invention in which an exclusive property or privilege is claimed are defined as follows:

1. A banknote validator comprising:

a banknote processing pathway configured to allow movement of banknotes, the banknote processing pathway including a banknote inlet at a downstream end through which banknotes are received, the banknote processing pathway including an initiation sensor adjacent the banknote inlet and configured to activate when a portion of the banknote is inserted through the banknote inlet;

a pair of drive rollers spaced in a width of and partially projecting into the banknote processing pathway at a position upstream of the initiation sensor, each of the drive rollers including an opposed passive roller located on an opposite side of and projecting into the banknote processing pathway to engage the respective drive roller when the banknote is not present and movable to accommodate a thickness of the banknote between the respective drive roller and passive roller;

a power drive arrangement configured to allow a same rotational speed or different rotational speeds of the drive rollers while the drive rollers maintain engagement with and drive a banknote with respect to the banknote processing pathway, the power drive arrangement being initiated by the activation of the initiation sensor and configured to use the different rotational speeds to correct for misalignment of the banknote, wherein the power drive arrangement includes a control arrangement configured to cause displacement and angular movement of the banknote to align and center the banknote with respect to a longitudinal axis of the banknote processing pathway based on sensor information including sensing of a leading edge of the banknote; and a series of evaluation sensors located on a side of the banknote processing pathway and configured to assess a validity of received banknotes as the received banknotes are driven through the banknote processing pathway.

2. The banknote validator of claim 1, wherein the initiation sensor is adjacent to the drive rollers.

3. The banknote validator of claim 1, further comprising:

a sensing arrangement configured to identify misalignment of an inserted end of the banknote positioned adjacent to the drive rollers and produce a misalignment signal communicated to the power drive arrangement, the power drive arrangement configured to, based on the misalignment signal, selectively drive the drive rollers at differential speeds to provide correction of the identified misalignment.

4. The banknote validator of claim 3, wherein the sensing arrangement is a sensing array extending across the banknote processing pathway adjacent to and upstream of the drive rollers.

5. The banknote validator of claim 3, wherein the sensing arrangement is spaced from the banknote inlet a distance less than forty percent of a length of a banknote capable of being validated by the banknote validator.

6. The banknote validator of claim 3, wherein the power drive arrangement comprises a separately controlled stepper motor associated with each of the drive rollers, wherein the sensing arrangement is a sensor array extending across the banknote processing pathway capable of sensing the leading edge and side edges of the banknote as it is moved over the sensor array, wherein the stepper motors are located between the banknote inlet and the sensor array; and wherein the control arrangement is configured to receive the sensor information from the sensor array and determine, based on the sensor information, a series of drive steps of the stepper motors including a differential drive of the stepper motors to cause the displacement and the angular movement of the banknote, used to align and center the banknote with respect to the longitudinal axis of the banknote processing pathway.

7. The banknote validator of claim 6, wherein the control arrangement is configured to (i) selectively drive the stepper motors to move a received end of a banknote over the sensor array sufficiently to identify an angular orientation of the banknote relative to the banknote processing pathway and (ii) thereafter selectively drive the stepper motors in a series of forward and reverse movements across the sensor array involving differential actuation of the stepper motors to align the end of the banknote such that a longitudinal axis of the banknote is aligned with the longitudinal axis of the banknote processing pathway and the banknote is centered in the processing pathway.

8. The banknote validator of claim 6, wherein the sensor array is spaced from the banknote inlet by less than 5 centimeters.

9. The banknote validator of claim 1, wherein the initiation sensor is a sensor array configured to identify misalignment of an inserted end of the banknote positioned adjacent to the drive rollers and produce a misalignment signal communicated to the power drive arrangement, the power drive arrangement configured to, based on the misalignment signal, selectively drive the drive rollers at differential speeds to provide correction of the identified misalignment.

10. The banknote validator of claim 1, wherein the drive rollers are positioned on opposite sides of a centerline of the banknote processing pathway.

11. The banknote validator of claim 1, wherein the drive rollers have a fixed axis of rotation extending across the banknote processing pathway.

12. The banknote validator of claim 1, wherein the drive arrangement includes a stepper motor for each drive roller, and the drive rollers are configured to be driven in a forward and rearward direction.

13. The banknote validator of claim 12, wherein the drive arrangement includes a sequence of incremental forward and rearward drive steps to align a received banknote with at least sixty percent of a length of the banknote extending outwardly beyond the banknote inlet.

14. The banknote validator of claim 13, wherein the drive arrangement includes a forward aligned drive mode, and wherein each drive roller is configured to be driven at the same rotational speed to move a banknote into the banknote processing pathway for validation by the series of evaluation sensors.

15. The banknote validator of claim 1, wherein the drive arrangement includes a banknote alignment mode comprising a series of incremental forward and rearward movements of a received end portion of a banknote used, wherein the banknote alignment mode comprises different rotational speeds of the drive rollers to align the banknote with the banknote processing pathway followed by a forward drive of the drive rollers at equal speed to move the banknote along the banknote processing pathway assessing the validity of the banknote.

16. The banknote validator of claim 1, wherein the power drive arrangement comprises a separately controlled stepper motor associated with each of the drive rollers.

17. The banknote validator of claim 1, wherein the control arrangement is configured to (i) selectively drive stepper motors to move a received end of a banknote over the sensor array sufficiently to identify an angular orientation of the end of the banknote relative to the banknote processing pathway and (ii) thereafter selectively drive the stepper motors in a series of forward and reverse drive steps involving differential actuation of the stepper motors to shift and align the end of the banknote such that a longitudinal axis of the banknote is generally aligned with the longitudinal axis of the banknote processing pathway.

18. A method of banknote alignment with respect to a centerline of a banknote processing pathway, the method comprising sensing an insertion of an end of a banknote into the banknote processing pathway;

activating a pair of stepper motors such that each stepper motor drives, via a drive roller, the end of the banknote at least partially over a sensor array extending across the processing pathway and stopping the stepper motors;

determining, based on a collective response of sensors of the sensor array, an approximate angle if a longitudinal axis of the banknote is at an angle relative to a longitudinal axis of the banknote processing pathway;

reversing the stepper motors using a differential drive therebetween to provide a corrective movement of the end of the banknote; and repeating the activating, determining, and reversing steps until a satisfactory alignment is determined by the sensor array to align a center of the banknote with the longitudinal axis of the banknote processing pathway, wherein reversing the stepper motors to provide the corrective movement to align the center of the banknote is based on a leading edge of the banknote included in sensor information of the sensor array, and thereafter driving each of the stepper motors equally to move the aligned banknote along the banknote processing pathway for evaluation.

19. The method as claimed in claim 18, wherein the drive rollers of each of the stepper motors remain in contact with the banknote during alignment thereof.

20. The method as claimed in claim 19, wherein each displacement of the banknote is less than approximately 0.5 cm.

21. The method of claim 18, wherein the end of the banknote is initially aligned with the longitudinal axis of the banknote processing pathway, further comprising:

determining any offset of the longitudinal axis of the banknote relative the longitudinal axis of the processing pathway; and performing corrective action by selective forward and reverse driving of the stepper motors to center the banknote end as determined by signals of the sensor array.

22. The method of claim 18, wherein reversing the stepper motors further comprises:

performing a net collective movement including at least four forward and three reverse movements of the end of the banknote to correct a maximum angular misalignment of the banknote end.

23. The method as claimed in claim 22, wherein a net corrective movement is at least six forward and five reverse movements.

24. The method of claim 18, wherein at least sixty percent of a length of the banknote during alignment extends outwardly away from a banknote inlet.

25. The method of claim 18, wherein at least sixty percent of a length of the banknote during alignment is unsupported at a position exterior to the banknote processing pathway.

26. The method of claim 18, further comprising:

selectively controlling the stepper motors to provide differential driving in a forward and reverse direction of the banknote end or matched driving of the drive rollers in the forward and reverse direction.

* * * * *